United States Patent [19]

North

[11] 4,102,236

[45] Jul. 25, 1978

[54] MOLDED CURVED DRUMS AND MOLDS THEREFOR

[76] Inventor: Roger W. North, 1332 SE. 16th, Portland, Oreg. 97214

[21] Appl. No.: 733,271

[22] Filed: Oct. 18, 1976

[51] Int. Cl.[2] ..... G10D 13/02

[52] U.S. Cl. ..... 84/411 R

[58] Field of Search ..... 84/411 R–420

[56] References Cited

U.S. PATENT DOCUMENTS

| | | | |
|---|---|---|---|
| 2,858,724 | 11/1958 | Troppe | 84/411 R |
| 3,603,194 | 9/1971 | North | 84/411 R |
| 3,621,749 | 11/1971 | Aluisi | 84/411 R |
| 3,818,791 | 6/1974 | Zickos | 84/411 R |

*Primary Examiner*—Lawrence R. Franklin

*Attorney, Agent, or Firm*—Klarquist, Sparkman, Campbell, Leigh, Hall & Whinston

[57] ABSTRACT

An arcuate, tapered drum shell changes from circular at its head end to generally elliptical at its central portion and back to circular at its trumpet end to permit an inner mold with a color coating to be inserted into an outer mold having a color coating without binding. Another arcuate, tapered drum shell has a continuously widening flare over the length of the drum shell with a continuous arc centerline to allow both inside and outside molds to be removed from the drum shell.

5 Claims, 7 Drawing Figures

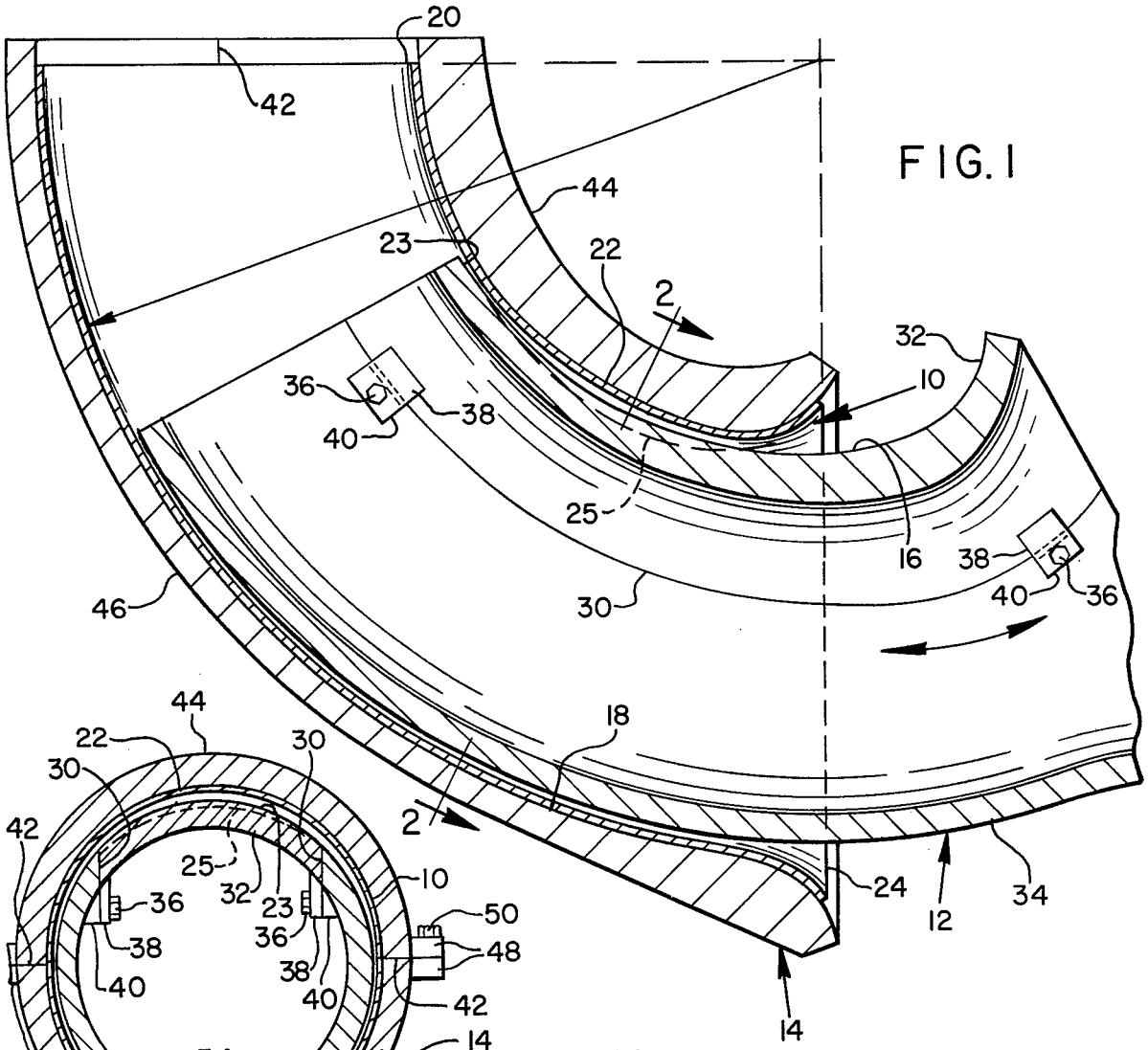
FIG. 1
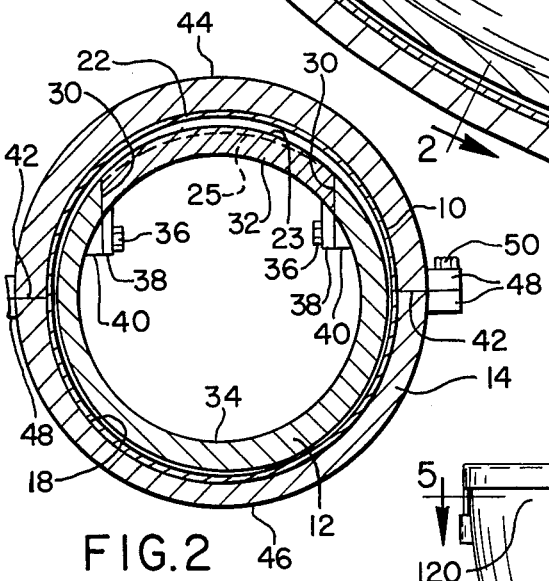
FIG. 2
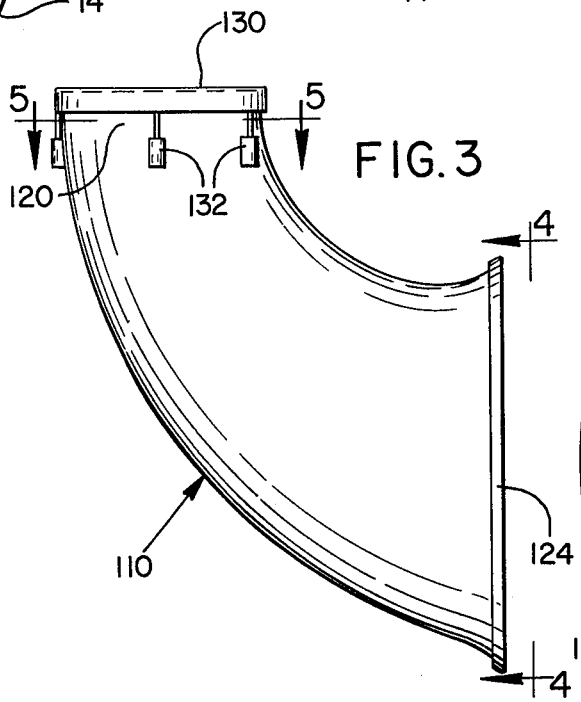
FIG. 3
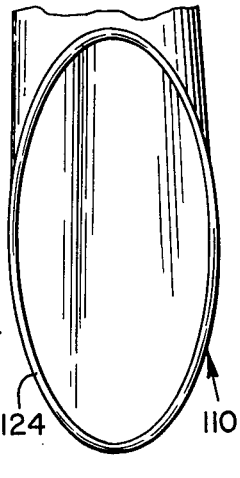
FIG. 4
FIG. 5
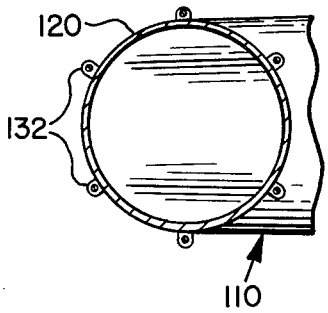

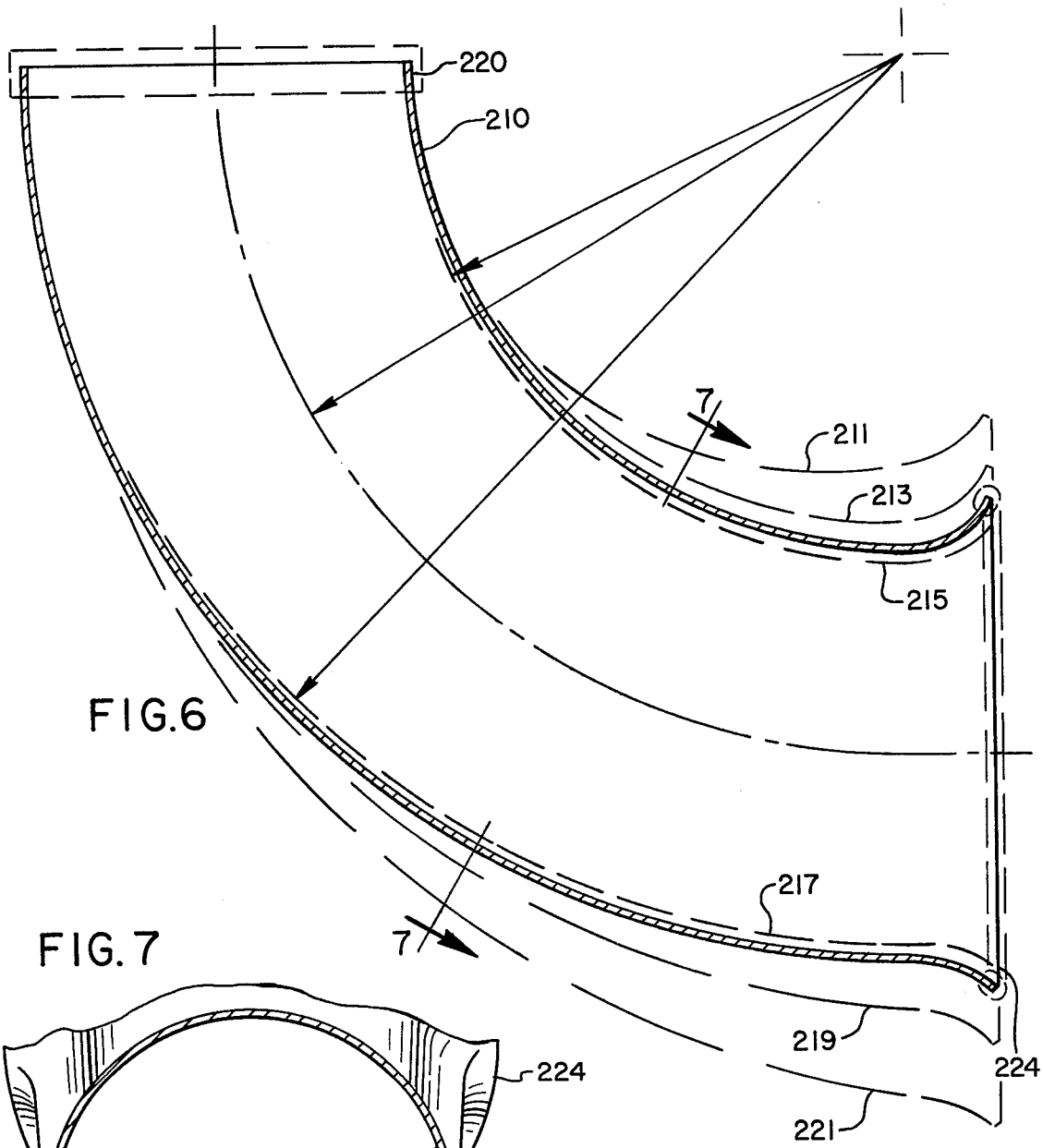
FIG.6
FIG. 7
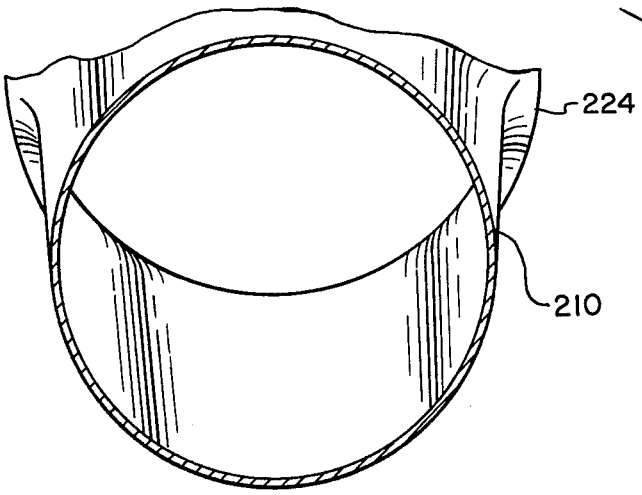

MOLDED CURVED DRUMS AND MOLDS THEREFOR

DESCRIPTION

This invention relates to easily molded curved drums and molds therefor, and has for an object thereof the provision of curved drums which are easily molded and molds therefor.

Curved drums such as those disclosed and claimed in my U.S. Pat. No. 3,603,194 provide excellent amplification and directivity of sound. These can be molded. However, when the drum's shell length is increased (desirable for acoustic reasons, to provide more tone and lower resonant pitch), it becomes impossible to insert the mold for the inside surface into the mold for the outside surface without first disassembling one or the other of the molds. This presents problems, particularly in fiberglass technology, as the best way to achieve a finished surface is to first apply by spraying a color coat to each waxed mold surface, and allow this to harden — then, insert the molds to their proper alignment, and pour or inject the construction material into the cavity so formed. In the case where one of the molds must be disassembled to allow such insertion, continuity of this color coat cannot be maintained, and costly touch up and/or refinishing are required to achieve the desired finish on both inside and outside of the drum shell.

Another object of the invention is to provide a curved drum shell molded by coated molds that can be assembled together without binding, the drum shell's cross-section changing from substantially circular to generally elliptical to relieve binding of the molds.

A further object of the invention is to provide a drum shell changing in cross-section from substantially circular at its head end to generally elliptical or oval at the throat end thereof to prevent binding of the molds.

Another object of the invention is to provide a curved drum shell having a continually widening flare over the length of the drum shell and a continuous arc as its centerline of the drum shell to allow an inner mold to be inserted into the outer mold without binding.

Another object of the invention is to provide unsplit inner and outer molds that can be removed from a molded drum shell without binding.

In the drawings:

FIG. 1 is a longitudinal sectional view of a drum shell and inner and outer molds forming embodiments of the invention;

FIG. 2 is a sectional view taken along line 2—2 of FIG. 1;

FIG. 3 is a side elevation view of a drum forming an alternate embodiment of the invention;

FIG. 4 is an end view taken along line 4—4 of FIG. 3;

FIG. 5 is a sectional view taken along line 5—5 of FIG. 3;

FIG. 6 is a longitudinal sectional view of a drum shell forming an alternate embodiment of the invention; and, FIG. 7 is a transverse sectional view taken along line 7—7 of FIG. 6.

A molded, tapered, curved or arcuate drum shell 10 (FIGS. 1 and 2) forming a specific embodiment of the invention is composed of a fiberglass reinforced plastic material such as, for example, an epoxy, and is molded by inner and outer molds 12 and 14 forming a specific embodiment of the invention. The inner mold is shown partially pulled out of the drum shell and outer surface 16 of the inner mold, when fully inserted, is complementary to, but spaced inwardly from inner surface 18 of the outer mold so that the thickness of the drum shell 10 is uniform throughout. At its head end 20, the drum shell is circular in transverse cross-section and at its central portion 22, the drum is substantially elliptical. At lower or trumpet end 24, the drum shell is circular but substantially larger in diameter than at its head end, the drum changing gradually from circular at its ends to pronouncedly elliptical at its central or throat portion. Dotted line 25 shows a true circle to illustrate the elliptical shape at the central portion, which provides sufficient clearance, along with the taper to permit the molds to be assembled together while unsplit for molding and to permit the mold 12 to be easily pulled out of the drum shell and the drum shell to be easily pulled out of the outer mold 14 without binding.

The inner mold is split along lines 30 to permit a segment 32 to be moved radially inwardly from a segment 34 after screws 36 have been unscrewed from pairs of clamping lugs 38 and 40 integral with the segments 32 and 34. The outer mold 14 is split along lines 42 to form separate segments 44 and 46. The segments 44 and 46 have flanges 48 secured together by screws 50.

In molding the drum shell 10, which spans an angle of from 60° to 90°, wax is applied to the molding surfaces 18 and 23 of the molds 12 and 14, which are separated from each other but with each in integral or unsplit condition. Then color coats are applied to both waxed surfaces, and the inner mold is inserted fully into the outer mold in proper alignment, after which a fiberglass reinforced resin, such as, for example, an epoxy resin, is poured or injected into the cavity and hardened. Then the inner mold is split and pulled out and then the outer mold is split and pulled off the shell. Actually, the elliptical portion provides enough clearance to permit the molds to be separated from the shell without splitting (disassembling) each mold.

EMBODIMENTS OF FIGS. 3-5

A drum shell 110 forming an alternate embodiment of the invention is like the shell 10 but changes gradually from circular at its head end 120 to elliptical at or just below where conventional tapped tightening elements 132 are positioned, the elements 132 being secured by a suitable adhesive or other fastening means to the drum shell. The elements 132 serve to keep taut a membrane 130 on the head end of the drum shell. The molds (not shown) for the drum shell 110 are like the molds 12 and 14 but, of course, are complementary in shape to the drum shell 110 which is uniform in thickness throughout.

Due to the taper and the elliptical shape of the shell 10, the inner mold can be easily slid into the outer mold without disrupting the color coat. Also, if desired, the inner mold can be easily slid out of the drum shell after the molding without binding, and the outer mold can easily be slid off the mold shell without binding, even though the molds are in integral or unsplit conditions.

EMBODIMENTS OF FIGS. 6 & 7

A drum shell 210 forming an alternate embodiment of the invention is circular throughout its length, and is tapered sufficiently that inner and outer molds generally like the molds 12 and 14, in unsplit conditions can be disassembled from the shell without binding. Circular curves 211, 213, 219 and 221 illustrate curvatures of the outer surfaces of the drum shells tapered even more than the shell 210 which can also be successfully molded in one piece with complementary integral or unsplit molds. Lines 215 and 217 illustrate a taper of a shell which can not be so extracted. The shell 210 has a head end 220 and a flared trumpet end 224.

The surfaces of the above-described drum shells 10, 110 and 210, both inner and outer, are very smooth and are not marred or scratched and there are no flash or parting lines.

What is claimed is:

1. A molded drum shell curved through a substantial angle in the order of 90° and having a head end and a trumpet end, the end being circular in transverse cross-section and having a predetermined diameter, the trumpet end having a minimum transverse dimension substantially larger than said predetermined diameter, the shell tapering from circular at the head end to generally elliptical proceeding from the head end toward the trumpet end.

2. The molded drum shell of claim 1 wherein the trumpet end of the shell is elliptical.

3. The molded drum shell of claim 1 wherein the trumpet end of the shell is substantially circular and the central portion of the shell is generally elliptical.

4. A molded drum shell having a head end and a trumpet end and curved proceeding therealong through an angle of approximately 90°, the drum shell being substantially circular at its head end and being increasingly larger in transverse cross-sectional shape proceeding from the head end toward the trumpet end, said transverse cross-sectional shape changing from circular to elliptical and increasingly elliptical at least to a point beyond the midpoint thereof.

5. The drum shell of claim 4 wherein the drum shell is also elliptical at its trumpet end.

* * * * *

UNITED STATES PATENT AND TRADEMARK OFFICE

CERTIFICATE OF CORRECTION

PATENT NO. : 4,102,236

DATED : July 25, 1978

INVENTOR(S) : ROGER W. NORTH

It is certified that error appears in the above-identified patent and that said Letters Patent are hereby corrected as shown below:

Col. 3, claim 1, line 4, before "end" insert --head--

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*